United States Patent [19]

Rabinowitz

[11] Patent Number: 4,606,526

[45] Date of Patent: Aug. 19, 1986

[54] FRAME HANGER

[76] Inventor: Fred Rabinowitz, 127 N. 19th St., Kenilworth, N.J. 07033

[21] Appl. No.: 650,368

[22] Filed: Sep. 13, 1984

[51] Int. Cl.[4] ..... A47G 1/16

[52] U.S. Cl. ..... 248/489; 248/475.1

[58] Field of Search ..... 248/489, 497, 488, 466, 248/475.1, 317, 490, 496; 40/156, 152.1, 152

[56] References Cited

U.S. PATENT DOCUMENTS

| | | | |
|---|---|---|---|
| 2,464,295 | 3/1949 | Edgar | 248/475.1 |
| 2,765,134 | 10/1956 | Hill | 248/497 |
| 3,946,512 | 3/1976 | Shapiro | 40/152.1 |
| 4,040,593 | 8/1977 | Wiley | 248/489 |
| 4,143,848 | 3/1979 | Slemmons | 248/489 |
| 4,211,022 | 7/1980 | Angelakos | 248/489 |
| 4,216,597 | 8/1980 | Kocina et al. | 40/152.1 |

*Primary Examiner*—Ramon O. Ramirez
*Attorney, Agent, or Firm*—Stefan J. Klauber

[57] ABSTRACT

A picture frame hanger according to the invention comprises a block of material, e.g. plastic, metal, or wood, having at least one lateral projection extending along one side thereof, to define a lip receivable into the inwardly-facing groove or channel of a picture frame which is hung thereupon. The said projection may be parallelepiped in form, e.g. of rectangular cross-section and of a thickness less than that of the block; or the projection may comprise a bevelled surface defined at one lateral side of the block, which bevel diverges in the direction opposite the support wall. Preferably the hanger includes both parallelepiped and bevelled projections on alternate edges to enable a wide flexibility in application of the device.

19 Claims, 6 Drawing Figures

FIG. 3
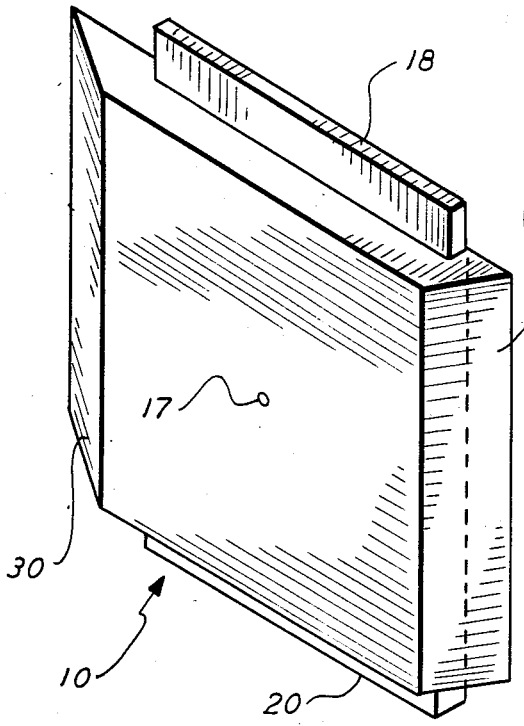
FIG. 4
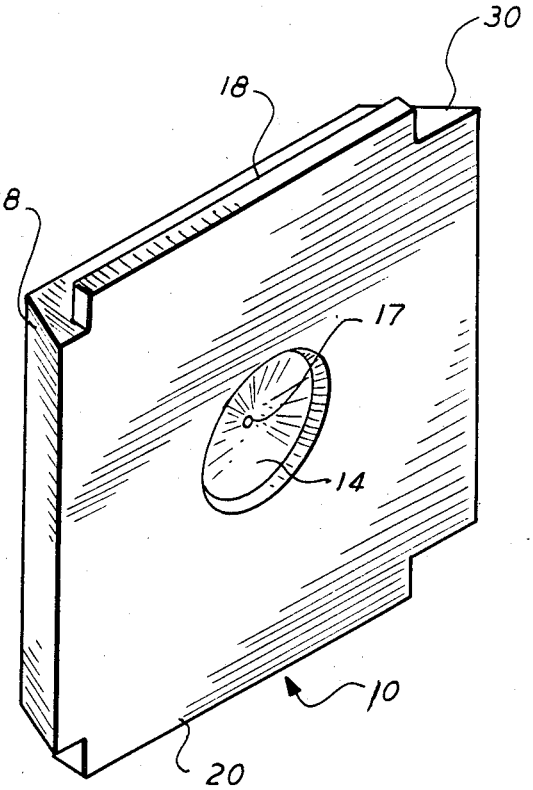
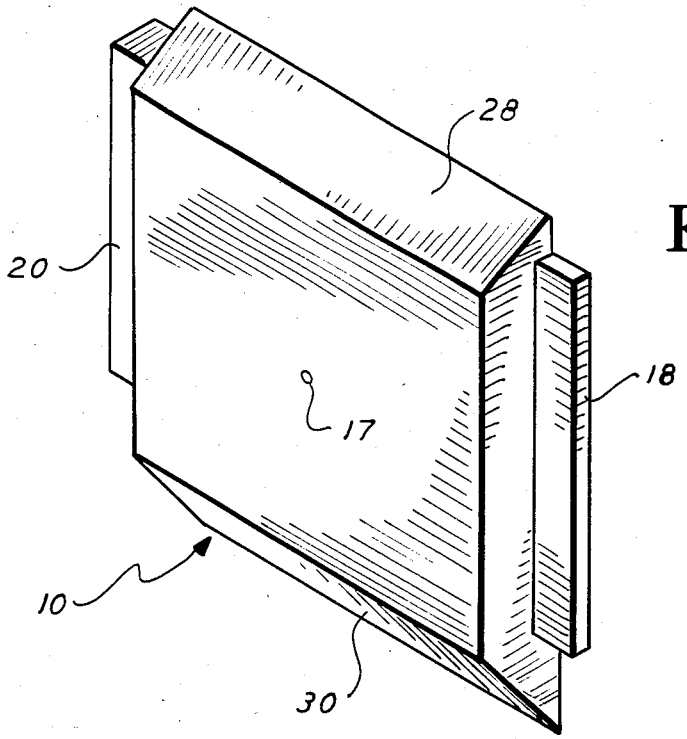
FIG. 5

FRAME HANGER

FIELD OF THE INVENTION

This invention relates to a frame supporting device, and in particular to a hanger for a picture frame.

BACKGROUND OF THE INVENTION

Traditionally, picture frames have been made of wood which surround an art object, or a photograph. To hang such a frame it is usual to insert, by screwing or fastening, threaded eyelets into opposite sides of the frame, and to thereupon pass a wire through and between the eyelets. The wire is then hung over a hook-type hanger, or upon a nail or the like inserted into a support wall.

More recently, inexpensive metal, and even plastic frames, have grown in popularity. It is generally impossible, or impractical, to insert eyelets in these frames and suspend the frame from a hanger via a wire passing through the eyelets. Although it is still possible to hang such frames from a picture hook, or nail, by receiving the hook at the inside, internally facing channel of such frames, in most instances portions of the hook will still be visible above the frame.

Some frames are provided with picture retaining clips, and the corners and along the sides, as shown, for example in U.S. Pat. No. 4,216,597. A wire may be inserted through hooks in the clips, and between the clips for supporting the picture frame from a hanger.

In U.S. Pat. No. 4,211,022, the frame is provided with a support element which projects rearwardly from the main backing panel, the support element fitting a hanger secured to a mounting surface for the framed picture.

While the foregoing references are indicative of the mannner in which picture frames may be mounted on a supporting surface, they are not suitable for hanging the more modern frames described above.

SUMMARY OF THE INVENTION

A picture frame hanger according to the invention comprises a block of material, e.g. plastic, metal, or wood, having at least one lateral projection extending along one side thereof, to define a lip receivable into the inwardly-facing groove or channel of a picture frame which is hung thereupon. The said projection may be parallelepiped in form, e.g. of rectangular cross-section and of a thickness less than that of the block; or the projection may comprise a bevelled surface defined at one lateral side of the block, which bevel diverges in the direction opposite the support wall. Preferably the hanger includes both parallelepiped and bevelled projections on alternate edges to enable a wide flexibility in application of the device.

In use the block of material may be secured to a supporting wall, or stud, by a conventional fastener, i.e. a nail or a screw. The hanger, such as a block, is preferably a thermoplastic resin formed by extrusion molding and can be substantially square. The rectangular or bevelled projecting portions, may have different thicknesses on opposite sides for receiving picture frames of different sizes and shapes.

An object of this invention is accordingly to provide a simple picture frame hanger for hanging a picture frame from a supporting wall.

Another object of the invention is to provide a picture frame hanger requiring no wires, books, eyelets, and the like to support the picture frame from a wall hanger.

A further object of the invention is to provide a picture frame hanger which is easy and simple to secure to a supporting wall or columnar support.

A still further object of the invention is to provide an inexpensive picture frame hanger which can be mounted on a supporting surface and can receive picture frames of a wide variety of frame constructions.

Yet another object of the invention is to provide a picture frame hanger particularly adapted for carrying a plastic or metal picture frame.

These and further objects will appear as the specification progresses.

The invention will be described in detail with reference to the accompanying drawing. However, the invention both as to its organization and scope is defined in the claims following this specification. The embodiments about to be described are therefore to be deemed illustrative and not limiting.

BRIEF DESCRIPTION OF THE DRAWINGS

In the drawings appended hereto:

FIG. 3 is rear perspective view of a hanger according to the invention;

FIG. 4 is a front perspective view of the hanger of FIG. 3;

FIG. 5 is a rear perspective view of the hanger of FIGS. 3 and 4 turned 90°.

DETAILED DESCRIPTION OF THE INVENTION

Figure 1:
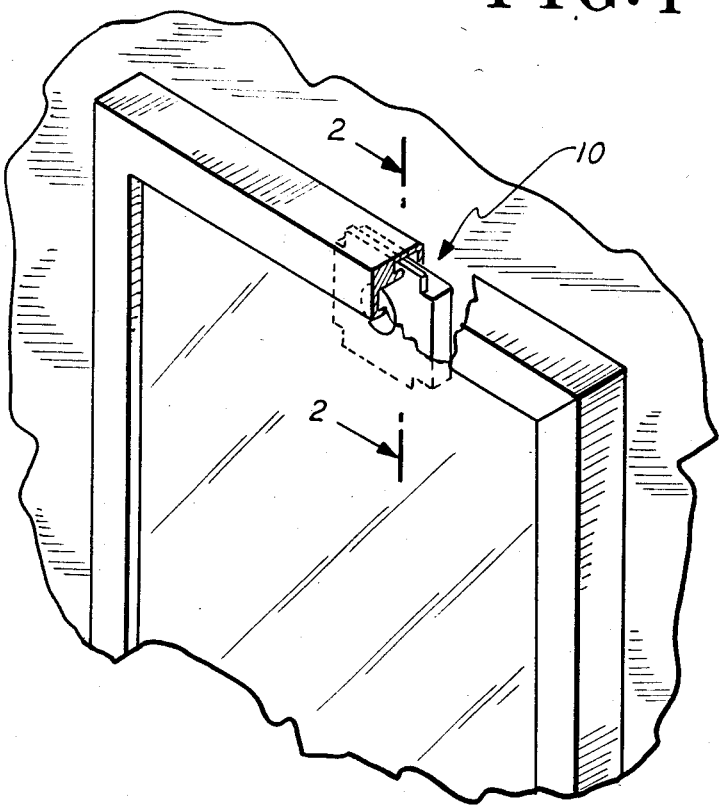
FIG. 1 is a perspective view, partially broken away, showing a picture frame supported by a picture frame hanger according to the invention.
Figure 2:
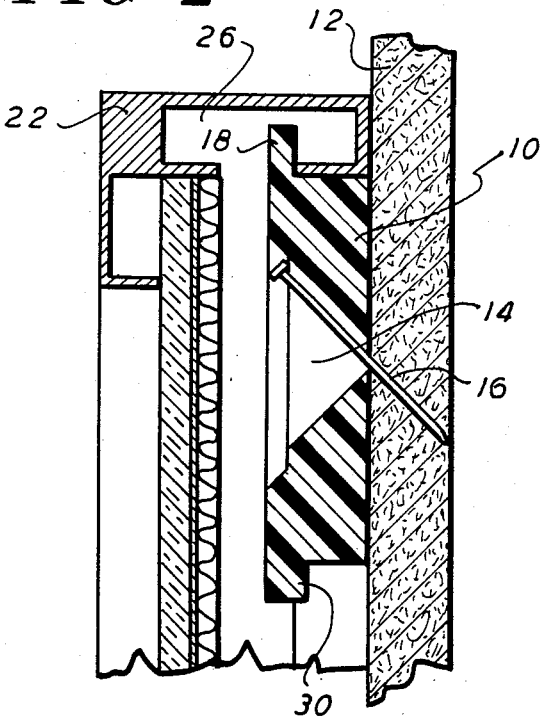
FIG. 2 is a side elevational view of a section taken along the line 2—2 in FIG. 1.

The picture frame hanger 10, shown in FIGS. 1 and 2, is secured to a supporting wall 12 by a nail 16, or similar fastening member such as a screw driven into the wall at an angle to the surface of the wall to insure better attachment. The hanger 10 is a block of material, e.g. wood or metal, but preferably a thermoplastic resin and formed by extrusion. The block 10 is provided with a cone-shaped aperture 14 for receiving the nail 16 which can then be driven into the wall 12 at an angle thereto. The block has, on opposite sides, two cross-section parallelapiped lateral projections 18 and 20, each of which may be of rectangular cross-section and can have a different lateral width, and a different thickness.

Projections 18 and 20 form lips which can mount a frame 22 which is of the type formed from sections having an internally directed groove or channel 26, into which the projections such as 18 are received. The projection 18 or 20 having the best fit relative to the dimensions of the groove or channel 26, is selected (or a bevelled surface is selected as discussed below); and the device 10 oriented so that the selected projection faces upwardly.

Figure 6:
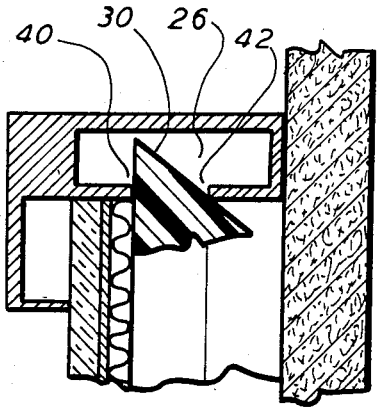
FIG. 6 is a partial view, similar to FIG. 2, but illustrating receipt of a bevelled projection in a picture frame.

In FIG. 6 a fragmentary view depicts the manner in which hanging on the bevelled projections such as 28 or 30 is effected. Projection 30 is simply received into channel 26 to the depth at which contact is made with the opposed edges 40 or 42. Such result will obtain depending upon the depth and width of channel 26, and upon the angle of the bevel. Accordingly, a selection will be made by trial and error as between the various projections 18, 20, 28 and 30, depending upon the frame characteristics, and especially upon the characteristics of channel 26.

In all instances, the picture frame hangs over, and conceals the hanger. No wires, hooks, eyelets, or other fastening devices are required. The hanger is easy to install. A nail is simply driven into the wall through the opening 17 provided in the hanger, and the picture frame emplaced over the hanger.

The hanger is inexpensive and can be made of a thermoplastic resin formed by extrusion.

Therefore, while the invention has been described with reference to the drawing showing various embodiments described in detail in this specification, the invention is not limited to those embodiments, but rather is defined in the claims appended hereto.

What is claimed is:

1. A picture frame hanger for use in mounting on a wall a picture frame of the type having an internally facing accessible channel at the frame sections thereof; said hanger comprising a block of material having two opposing substantially planar surfaces with sides extending therebetween and, adapted to be secured to a supporting wall or columnar member, said block of material having a projection extending laterally along at least two sides thereof, each forming a lip receivable into said accessible frame channel, for supporting said frame when said block is secured upon said wall, at least one said projection being formed by said block side being bevelled in a direction wherein said block side diverges away from said block surface which is adapted to be secured to said supporting wall.

2. A device in accordance with claim 1, wherein at least one said projection is a parallelepiped which is elongated along said side of said block.

3. A picture frame hanger as claimed in claim 2, wherein the block has two parallelepiped projections extending from different sides of said block and two bevelled surfaces extending from two other sides of said block, whereby said block is adapted to be used for frames having accessible channels with a variety of dimensions.

4. A picture frame hanger as claimed in claim 2, wherein the material is a thermoplastic resin.

5. A picture frame hanger as claimed in claim 4, wherein the block is an extruded thermoplastic resin.

6. A picture frame hanger as claimed in claim 2, in which the block material is metal.

7. A picture frame hanger a claimed in claim 2, in which the block material is wood.

8. A picture frame hanger as claimed in claim 2, wherein the block is substantially square.

9. A picture frame hanger as claimed in claim 2, wherein the parallelepiped projections are rectangular and have a thickness substantially less than the thickness of the block.

10. A picture frame hanger as claimed in claim 9, wherein the projections each have a different width.

11. A picture frame hanger as claimed in claim 10, wherein the projections each have a different thickness.

12. A picture frame hanger as claimed in claim 2, wherein the bevelled sides are bevelled at different angles.

13. A picture frame hanger as claimed in claim 1, wherein the block of material has a cone-shaped aperture for receiving a fastening element which can be secured into the supporting member of an angle thereto.

14. A picture frame hanger as claimed in claim 1, wherein one surface of said lateral extension extends substantially in the plane of the planar surface of said block opposite to the surface adapted to be secured to the supporting wall.

15. A picture frame hanger as claimed in claim 3, wherein one surface of said lateral extensions extends substantially in the plane of the planar surface of said block opposite to the surface to be secured to the supporting wall.

16. A picture frame hanger as claimed in claim 1 wherein the block of material has an aperture in a surface thereof.

17. A picture frame hanger for use in mounting on a wall a picture frame of the type having an internally facing accessible channel at the frame sections thereof; said hanger comprising a block of material having two opposing substantially planar surfaces with sides extending therebetween adapted to be secured to a support wall or columnar member; said block of material having a projection extending laterally along one side thereof with one surface of said projection extending substantially in the plane of the planar surface of said block opposite to the surface adapted to be secured to a support wall, said projection being formed by said block side being bevelled in a direction wherein said block side diverges away from the block surface adapted to be secured to said support wall, said bevel forming a lip enabling said projection to be received into frames having accessible channels with a variety of dimensions for supporting a frame upon a wall.

18. A picture frame hanger as claimed in claim 17 wherein the block of material has an aperture in a surface thereof.

19. A picture frame hanger as claimed in claim 17 wherein the block of material has a cone-shaped aperture for receiving a fastening element which can be secured into a supporting member at an angle thereto.

* * * * *